US007802937B1

(12) United States Patent
Szekely

(10) Patent No.: US 7,802,937 B1
(45) Date of Patent: Sep. 28, 2010

(54) SAMPLE APPLICATOR

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 1070 days.

(21) Appl. No.: 11/466,786

(22) Filed: Aug. 24, 2006

Related U.S. Application Data

(60) Provisional application No. 60/711,154, filed on Aug. 24, 2005.

(51) Int. Cl.
*B43K 21/02* (2006.01)

(52) U.S. Cl. ..... 401/98; 401/55

(58) Field of Classification Search ..... 401/49, 401/52, 55, 98; 264/320, 322, 323
See application file for complete search history.

(56) References Cited

U.S. PATENT DOCUMENTS

| | | | | |
|---|---|---|---|---|
| 3,061,084 | A * | 10/1962 | Tibbitts | 401/98 |
| 4,726,700 | A * | 2/1988 | Gray | 401/183 |
| 5,312,240 | A * | 5/1994 | Divone et al. | 425/385 |
| 5,326,185 | A | 7/1994 | Dornbusch et al. | |
| 5,799,667 | A | 9/1998 | Szekely | |
| 7,461,992 | B2 * | 12/2008 | Griffon | 401/266 |

* cited by examiner

*Primary Examiner*—David J Walczak
(74) *Attorney, Agent, or Firm*—Bachman & LaPointe, P.C.

(57) ABSTRACT

A method for filling a personal care product applicator comprises flowing an amount of said personal care product into a one piece body of the applicator through a first end thereof. The flowing leaves the product in a first location within the body atop a transverse web. A closure is secured to the body at the first end. The web is displaced to shift the product from the first location.

15 Claims, 2 Drawing Sheets

SAMPLE APPLICATOR

CROSS-REFERENCE TO RELATED APPLICATION

Benefit is claimed of U.S. patent application Ser. No. 60/711,154, entitled "SAMPLE APPLICATOR", and filed Aug. 24, 2005, the disclosure of which is incorporated by reference herein as if set forth at length.

BACKGROUND OF THE INVENTION

The invention relates to personal care. More particularly, the invention relates to sample-size applicators for underarm antiperspirant and/or deodorant.

U.S. Pat. No. 5,799,667 (the disclosure of which is incorporated by reference herein as if set forth at length) discloses a bottom-fill sample applicator for product such as underarm antiperspirant and/or deodorant.

U.S. Pat. No. 5,326,185 discloses a two-piece top-fill sampler. The product is initially poured into a channel in the body around a perimeter of a central upward projection. The body is inverted, allowing the product to flow over the top of the projection for cooling. After cooling, the channel is left empty. In one non-illustrated embodiment, the underside of the cap molds the exposed surface of the product.

SUMMARY OF THE INVENTION

On aspect of the invention involves a method for filling a personal care product applicator comprising flowing an amount of said personal care product into a one piece body of the applicator through a first end thereof. The flowing leaves the product in a first location within the body atop a transverse web. A closure is secured to the body at the first end. The transverse web is displaced to shift the product from the first location.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
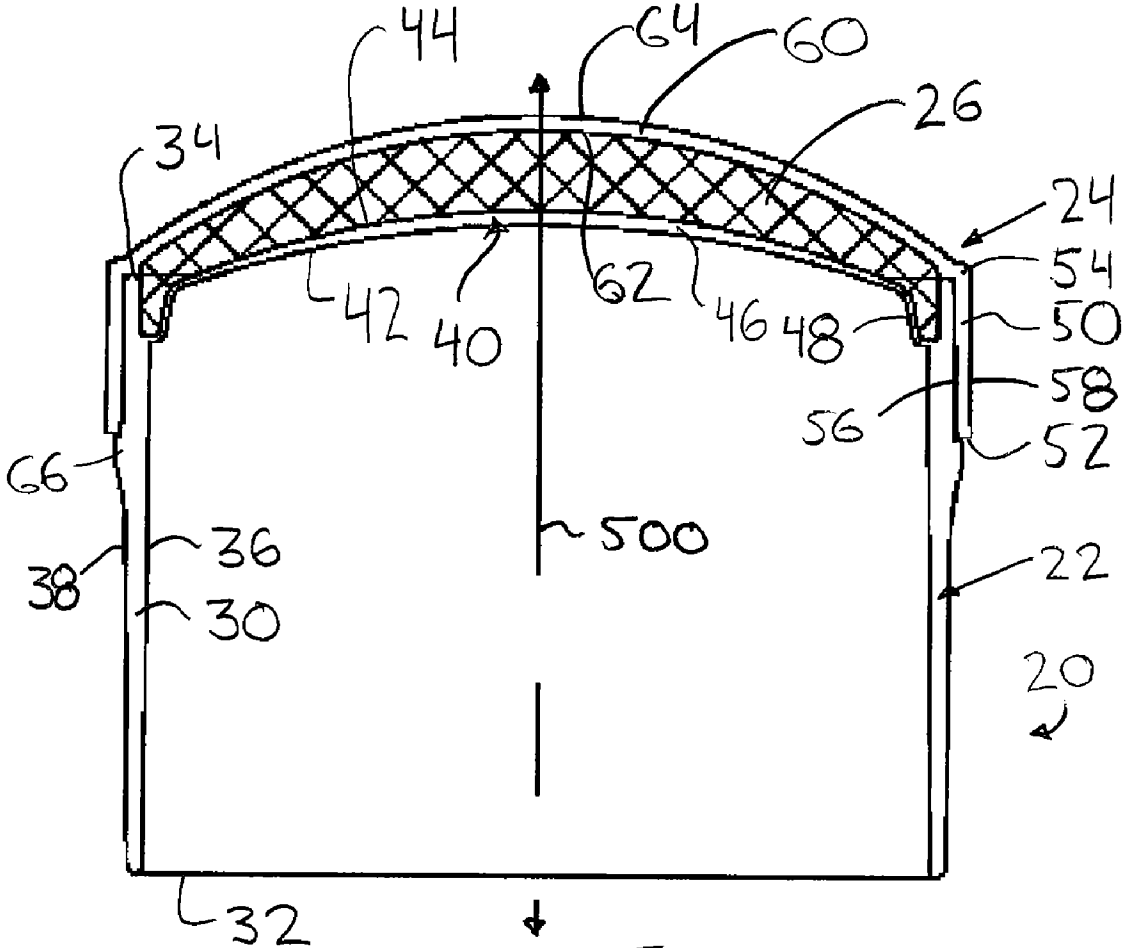
FIG. 1 is a lengthwise central vertical sectional view of a sample applicator.
Figure 2:
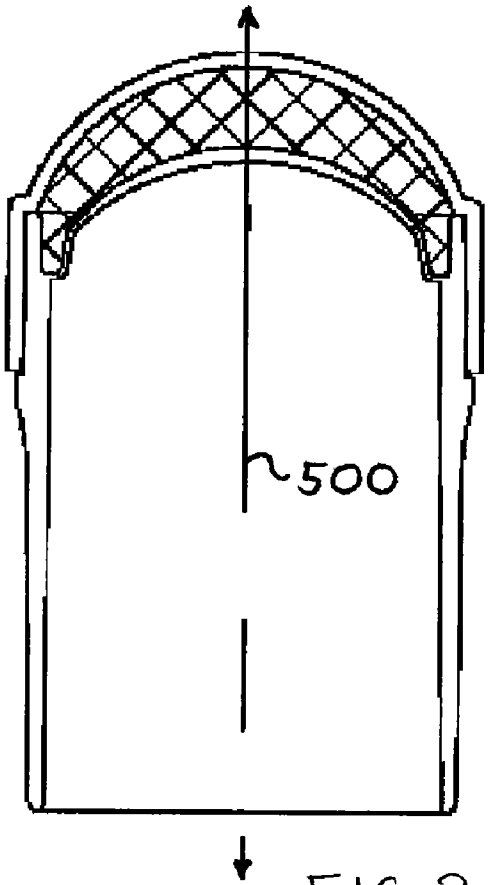
FIG. 2 is a transverse central vertical sectional view of the applicator of FIG. 1.

FIGS. 1 and 2 show a filled applicator 20. The applicator 20 includes a one-piece molded plastic (e.g., polypropylene or polyethylene) body 22, a one-piece molded plastic cap/closure 24 (e.g., also polypropylene), and personal care product 26. Exemplary product 26 is an antiperspirant and/or deodorant composition having properties as discussed in U.S. Pat. No. 5,799,667 (the '667 patent) cited above. An exemplary quantity of the product is 8-20 grams, more narrowly 10-15 grams.

The exemplary body 22 comprises a sidewall 30 extending upward from a lower end/rim 32 to an upper end/rim 34 and having inner/inboard and outer/outboard surfaces 36 and 38, respectively. For reference, a central vertical axis 500 is also shown. The orientation and directions specified reference typical storage and retail display orientation and are used for ease of understanding. They do not mandate that the applicator be maintained in such orientation. A transverse web 40 is unitarily formed with the sidewall 30 and extends inward from a perimeter junction with the sidewall inboard surface 36. The web 40 has a lower surface (underside) 42 and an upper surface 44. The web includes a central portion 46 and a perimeter portion 48. The exemplary applicator has an elongate footprint. Exemplary footprint is essentially elliptical with a length about twice a width.

The cap 24 includes a sidewall 50 extending upward from a lower end/rim 52 to an upper end 54 and having inner/inboard and outer/outboard surfaces 56 and 58, respectively. An upwardly convex dome 60 extends inward/upward from a junction with the sidewall at the upper end 54. The dome has a lower surface 62 and an upper surface 64. In the exemplary applicator, the body sidewall 30 includes an outwardly-extending shoulder 66 engaging the cap sidewall lower end 52 when the cap is in its installed condition/position.

Figure 4:
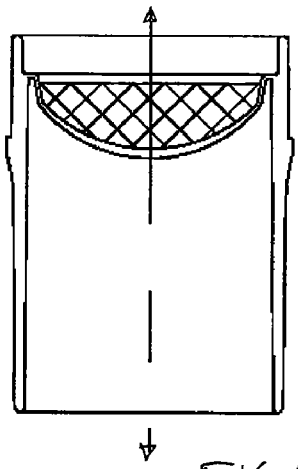
FIGS. 3 and 4 are longitudinal and transverse central vertical sectional views of a body of the applicator of FIG. 1 during a first intermediate stage of applicator assembly.

As is discussed in further detail below, the web 40 is shown in an upwardly-shifted condition/position in FIGS. 1 and 2. The web may be shifted to this condition/position from a lower condition/position of FIGS. 3 and 4. An exemplary shift is by an over-center toggling action wherein the web is self-retaining in both conditions/positions. The transition from the first condition to the second condition causes the web (or at least the central portion (which represents a majority area portion of it) to shift from concave up to convex up.

Figure 6:
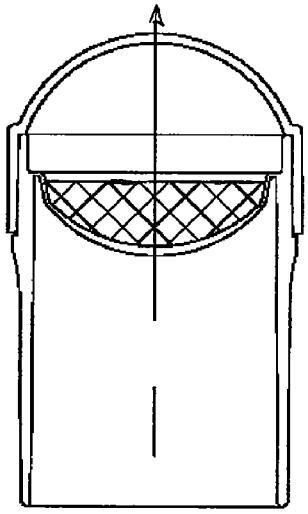
FIGS. 5 and 6 are longitudinal and transverse central vertical sectional views of the body of the applicator of FIG. 1 during a second intermediate stage of applicator assembly.
Figure 5:
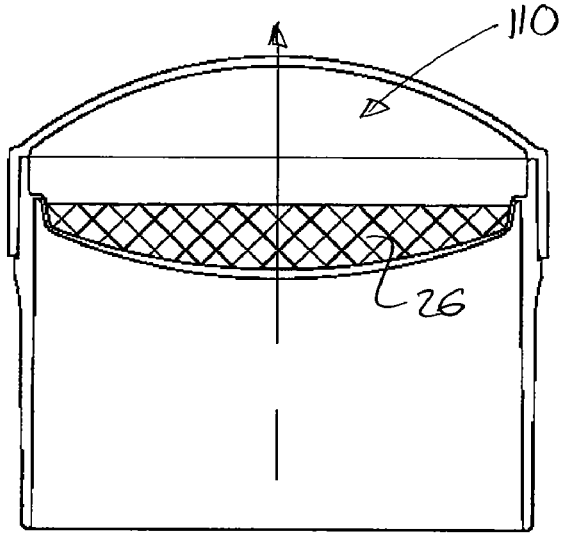
Figure 3:
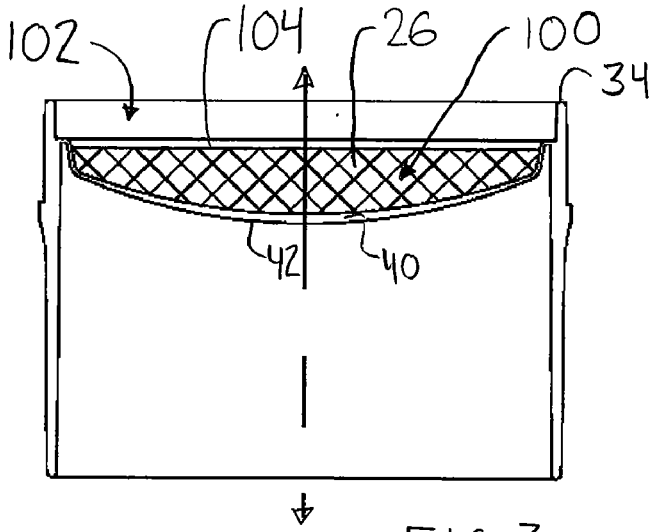

During a filling sequence, the cap 24 is initially in an uninstalled condition/position and the web 40 is initially in its lower condition/position. In the exemplary lower condition/position, a chamber 100 is formed in the sidewall above the web 40 and below the rim 34. With the web in this condition, the product 26 may be introduced in liquid form through the open upper end of the body. The product may be pre-heated for flowability as in the '667 patent. The exemplary filling only fills a lower portion of the chamber 100, leaving an empty upper portion 102. FIG. 3 further shows an upper surface/meniscus 104 of the as-introduced product 26. The product 26 may be allowed to fully or partially cool to at least partially solidify. The cap 24 may be installed (FIGS. 5 and 6) leaving an empty space 110 above the product 26. The web 40 may be shifted upward to the upper condition/position by the application of pressure to the web underside 42 (e.g., via insertion of a finger or tool through the open lower end of the body). During displacement, air may be driven from the chamber 110 (e.g., with the pressure creating a temporary gap between the closure and body). It may be advantageous to hold the body to the cap during this stage (e.g., in a fixture) to prevent any excessive separation. The web displacement also upwardly displaces the product 26 so that the product 26 protrudes above the rim 34. In the exemplary applicator, the web 40 also protrudes above the rim 34.

The product may further cool to further harden. During the hardening, the underside 62 of the dome 60 may mold the product. To help the molding, the container may be inverted. Alternatively, there may be no or partial molding. For example, if the product has sufficiently solidified, the toggling may be performed in the absence of the cap, with the product being just sufficiently deformable to not be ejected or broken up. In the installed condition, the cap/closure 24 may be nondestructively removably secured to and replaceable on the body.

Relative to previous bottom-fill applicators, there may be several advantages. There may be greater cleanliness because the product will not be forced back through the web. This may allow elimination of a bottom closure (e.g., plug). Relative to the top-fill sampler of U.S. Pat. No. 5,326,185, this may also permit greater flexibility in the choice of product and fill techniques. For example, product and storage flexibility (e.g., ability to withstand heat) may be improved because product reflow is not a problem.

One or more embodiments of the present invention have been described. Nevertheless, it will be understood that various modifications may be made without departing from the spirit and scope of the invention. For example, a variety of applicator shapes may be presented. Accordingly, other embodiments are within the scope of the following claims.

What is claimed is:

1. A personal care product applicator single piece molded plastic body comprising:

a sidewall having an upper end and a lower end; and a transverse web separating open upper and lower body compartments, the web having shape and dimensions effective to toggle between: a first condition and a second condition, the second condition being relatively upward of the first condition and wherein the web is, along a majority portion, convex upward in said second condition and concave upward in said first condition.

2. An applicator apparatus comprising:

the body of claim 1 wherein the web is in the second condition;

an antiperspirant and/or deodorant composition in the upper compartment and protruding beyond an upper rim of the sidewall; and a closure removeably secured to the body at the upper end.

3. The apparatus of claim 2 wherein:

the closure is nondestructively removeably secured to and replaceable on the body; and the composition has a mass of 8-20 grams.

4. The apparatus of claim 2 wherein:

there is no closure at the bottom end.

5. The apparatus of claim 2 wherein:

the closure is nondestructively removeably secured to and replaceable on the body; and the composition has a mass of 10-15 grams.

6. The apparatus of claim 2 wherein:

the body has an essentially non-circular elliptical transverse footprint.

7. A method for filling a personal care product applicator comprising:

flowing an amount of a personal care product into a one-piece body of the applicator through a first end thereof, the flowing leaving the product in a first location within the body;

securing a closure to the body at the first end; and displacing a transverse web of the body within a sidewall of the body to displace the product from the first location, the displacing shifting a portion of the web from a first concave upward condition to a second convex upward condition.

8. The method of claim 7 wherein:

the displacing is after the securing; and the displacing at least partially molds the product against an interior surface of the closure.

9. The method of claim 7 wherein:

the displacing is after the securing; and the displacing causes the product to protrude from the first end.

10. The method of claim 7 wherein:

the displacing comprises a toggling.

11. The method of claim 10 wherein:

the composition sets after the toggling.

12. A method for filling a personal care product applicator comprising:

flowing an amount of said personal care product into a one-piece body of the applicator through a first end thereof, the flowing leaving the product in a first location within the body;

securing a closure to the body at the first end; and after securing, displacing a transverse web of the body within a sidewall of the body to displace the product from the first location, the displacing at least partially molding the product against an interior surface of the closure.

13. The method of claim 12 wherein:

the displacing is after the securing; and the displacing causes the product to protrude from the first end.

14. The method of claim 13 wherein:

the displacing comprises a toggling.

15. The method of claim 14 wherein:

the composition sets after the toggling.

* * * * *